United States Patent [19]

Wimsatt et al.

[11] 4,314,385

[45] Feb. 9, 1982

[54] CARPET CLEANING SYSTEM

[75] Inventors: James M. Wimsatt; Patrick E. Lynch, Jr., both of Carson City, Nev.

[73] Assignee: WLN Products, Reno, Nev.

[21] Appl. No.: 163,036

[22] Filed: Jun. 26, 1980

[51] Int. Cl.[3] ..... A47L 7/00

[52] U.S. Cl. ..... 15/321; 15/323; 15/328; 15/352; 15/353; 15/339

[58] Field of Search ..... 15/320, 321, 322, 328, 15/331, 323, 353, 352, 339

[56] References Cited

U.S. PATENT DOCUMENTS

| | | | |
|---|---|---|---|
| 2,639,005 | 5/1953 | Gerstmann | 15/353 X |
| 2,844,840 | 7/1958 | Gray | 15/321 |
| 3,029,461 | 4/1962 | Osborn | 15/353 X |
| 3,180,071 | 4/1965 | Nolte | 15/353 X |
| 3,343,199 | 9/1967 | Nolte | 15/321 X |
| 3,840,935 | 10/1974 | Fitzgerald | 15/322 |
| 4,167,800 | 9/1979 | Tribolet | 15/331 |
| 4,216,563 | 8/1980 | Cyphert | 15/328 X |

FOREIGN PATENT DOCUMENTS

| | | | |
|---|---|---|---|
| WO79/00755 | 10/1979 | World Intel. Prop. Org. | 15/321 |

*Primary Examiner*—Chris K. Moore

*Attorney, Agent, or Firm*—Townsend and Townsend

[57] ABSTRACT

The present invention provides a carpet cleaning system which is convertible between a vacuuming configuration and a liquid cleaning configuration.

12 Claims, 11 Drawing Figures

FIG. 9.
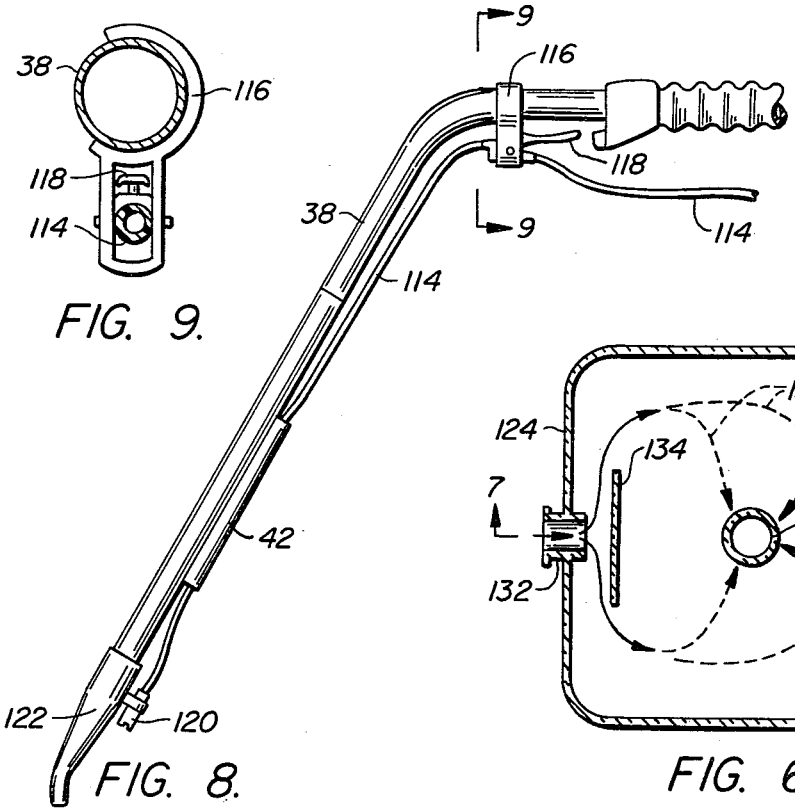
FIG. 8.
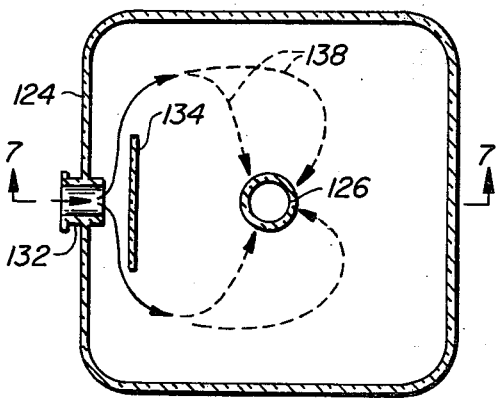
FIG. 6.
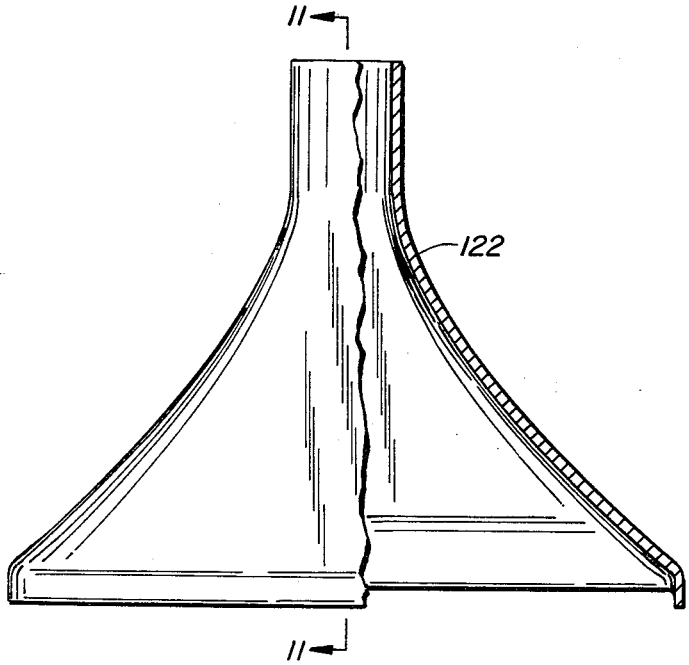
FIG. 10.
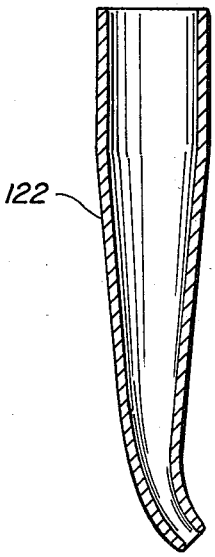
FIG. 11.

CARPET CLEANING SYSTEM

BACKGROUND OF THE INVENTION

The present invention relates to a carpet cleaning system which is convertible between a vacuuming configuration and a liquid cleaning configuration.

Complete carpet care requires that the carpets be cleaned in two different ways. The carpet must be frequently vacuumed to remove dirt and dust particles on a regular basis so that such particulate matter does not become embedded in the carpet and discolor the nap of the carpet. However, even with frequent vacuuming, a certain amount of discoloration inevitably occurs, and the carpet must occasionally be cleaned with a liquid detergent to remove such discoloration.

Conventional vacuum cleaners are used to provide the suction and brushing action necessary to remove particulate matter from a carpet. Such vacuum cleaners do not provide a liquid cleaning action, and large, relatively expensive units are typically used for this task. Because of the complexity of such liquid cleaning units, and the lack of frequency of their use, they are usually rented and not purchased by a home owner.

Of recent date, certain systems have appeared on the market which incorporate both vacuuming and liquid cleaning in a single unit. Generally speaking, such units are basically liquid cleaning devices which have been adapted for use as vacuuming systems as well. Typically, the water collection portion of the liquid cleaning device is simply replaced with a vacuum bag, or an alternative mechanism for trapping particulate matter. However, such devices are generally unacceptable in their vacuuming mode because they are vastly inferior to a standard vacuum cleaner. In addition, their use as liquid cleaning systems is degraded as well. The net result is a system which is not fully acceptable for either vacuuming or liquid cleaning.

SUMMARY OF THE INVENTION

The present invention provides a carpet cleaning system which is convertible between a vacuuming configuration and a liquid cleaning configuration. The system includes a canister with a motor compartment and a chamber partially overlying the motor compartment and in communication therewith through an aperture in the top of the motor compartment. The chamber also has a bag-receiving cavity. An upwardly opening hatch is provided in the canister for access to the chamber above the motor compartment, and access to also provided to the bag-receiving cavity. A vacuum hose connection penetrates the bag-receiving cavity of the chamber.

An air pump is located in the motor compartment, and has an input side communicating with the chamber through the aperture in the top of the motor compartment. A liquid pump is also located in the motor compartment, and has an input side communicating with an input fitting inside the chamber, and an output side communicating with an output fitting on the exterior of the chamber.

An air tight dome is engaged with the hatch when the system is in the vacuuming configuration. A recovery tank is inserted in the hatch when the system is in the liquid cleaning configuration. The recovery tank includes a liquid cleaning hose connection penetrating the tank, and a central vertical pipe communicating with a hole in the base of the tank. When the tank is inserted in the hatch, the hole is aligned with the aperture in the top of the motor compartment.

A filter bag is inserted in the bag-receiving cavity when the system is in the vacuuming configuration. The filter bag is connected to the vacuuming hose connection which penetrates the canister. A solution bag is inserted in the bag-receiving cavity when the system is in the liquid cleaning configuration. The solution bag is connected to the input fitting through the liquid pump. A cleaning solution dispensing tube is attached to the outer fitting of the liquid pump when the system is in the liquid cleaning configuration to dispense a cleaning solution from the solution bag.

A hose and wand assembly is attached to the vacuuming hose connection with the system in the vacuuming configuration. The air pump draws air through the hose and wand into the filter bag and out through the walls of the bag to provide a vacuuming action. The hose and wand assembly is attached to the liquid cleaning hose connection in the liquid cleaning configuration so that air drawn from the tank through the vertical pipe by the air pump provides suction to draw the dispensed cleaning solution through the hose and wand and into the recovery tank.

The present invention thus provides a single device which is convertible from a complete vacuum cleaner to a complete liquid cleaner. In the vacuuming mode, the system of the present invention provides a vacuum cleaner which will operate with the same efficiency as a standard vacuum cleaner. By the same token, in its liquid cleaning mode, the present invention operates as a standard liquid cleaning system. No compromise between the two functions is necessary which would degrade the efficiency of either.

The present invention provides for both vacuuming and liquid cleaning of carpets in a relatively simple and straightforward single device. Its relative simplicity is achieved by the common use of many components. For example, the air pump provides the suction necessary for both vacuuming and water extraction. The bag compartment holds a filter bag for vacuuming, and a solution bag for liquid cleaning. The present invention thus provides a relatively inexpensive unit for complete carpet cleaning, one which is within the financial capabilities of most homeowners and other potential users.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 6 is a plan sectional view of the recovery tank used in the preferred embodiment in its liquid cleaning configuration;

FIG. 8 is an elevation view of the hose and wand assembly of the preferred embodiment as utilized in the liquid cleaning configuration;

FIG. 9 is a sectional view taken along lines 9—9 of FIG. 8;

FIG. 10 is an enlarged view of the suction head used in the preferred embodiment in its liquid cleaning configuration with portions cut away; and FIG. 11 is a sectional view taken along lines 11—11 of FIG. 10.

DESCRIPTION OF THE PREFERRED EMBODIMENT

Figure 1:
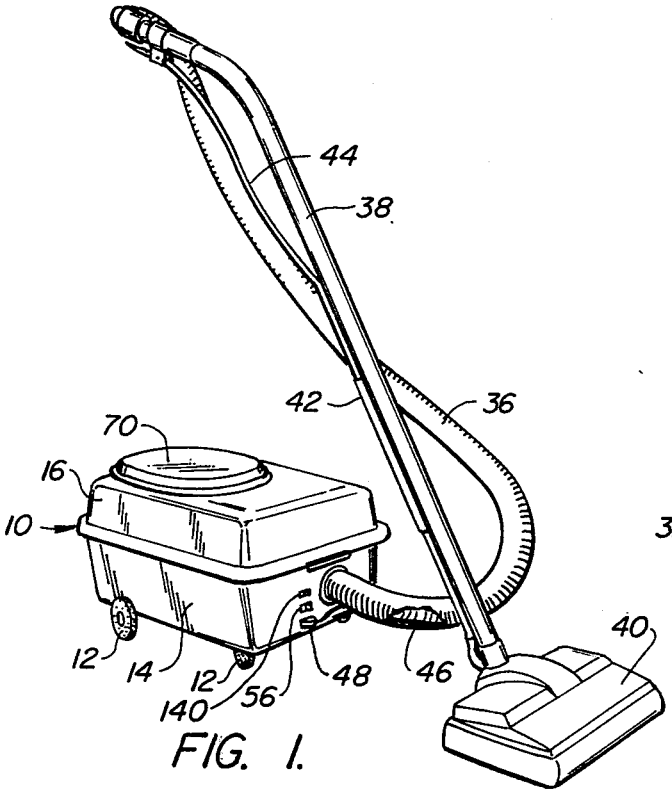
FIG. 1 is a perspective view of a preferred embodiment of the system of the present invention in its vacuuming configuration.
Figure 3:
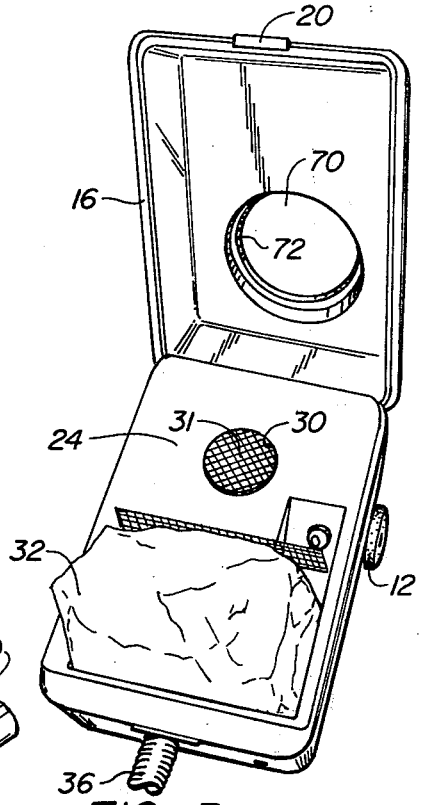
FIG. 3 is a perspective view of the preferred embodiment in its vacuuming configuration with the cover raised.
Figure 2:
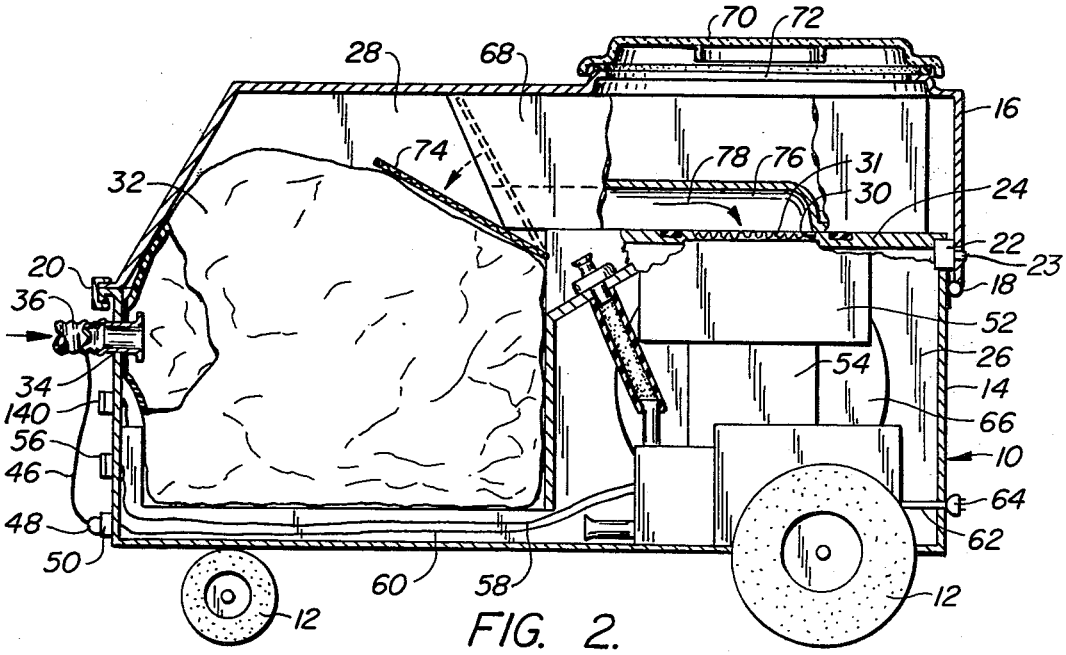
FIG. 2 is a side sectional partially cut away view of the preferred embodiment in its vacuuming configuration.

The preferred embodiment of the present invention in its vacuuming configuration is illustrated by way of reference to FIGS. 1-3. The preferred embodiment in the liquid cleaning configuration is illustrated by way of reference to FIGS. 4-11. As is clear from the following description, the preferred embodiment is convertible between its vacuuming configuration and its liquid cleaning configuration.

1. Vacuuming Configuration

Referring initially to FIGS. 1-3, the preferred embodiment includes a canister 10 which rides on wheels 12. Canister 10 generally comprises a lower housing 14, and a cover 16 attached to housing 14 by a hinge 18. A latch 20 secures cover 16 to housing 14 so that the cover and housing in combination form a sealed container. A pressure switch 22 is used to actuate warning light 23 to indicate too low a pressure in the sealed container caused by plugging or bag fill.

An interior structural wall 24 is located within housing 14, and divides the interior of the housing and cover 16 into a motor compartment 26 and a chamber 28. A portion of chamber 28 overlies motor compartment 26, and the remaining portion of the chamber forms a cavity generally to the side of the motor compartment. Aperture 30 is located in structural wall 24 overlying motor compartment 26 to allow air to pass between chamber 28 and the motor compartment. An air filter element 31 is interposed in aperture 30.

In the vacuuming configuration, a filter bag 32 is located within the cavity portion of chamber 28 along side motor compartment 26. A vacuum hose fitting 34 penetrates the side wall of housing 14 into the cavity, and filter bag 32 is attached to the inside of vacuum hose fitting 34.

A hose 36 and wand 38 are attached to the exterior portion of vacuum hose fitting 34. A conventional electrically powered vacuuming head 40 is attached to the free end of wand 38. A slit tube 42 is located along the underside of wand 38, and engages power cord 44 attached to a power cord 46 within hose 36. Power cord 46 terminates in a plug 48 engaging in electrical outlet 50 on the exterior of canister 10.

An air pump 52 is located in the upper part of motor compartment 26 immediately below aperture 30. Air pump 52 is powered by an electric motor 54 controlled by a switch 56 attached to motor 54 by lead 58. Switch 56 is located proximate plug 50, and plug 50 is connected to a lead 60 leading to a source of electrical power in the motor compartment. Electrical power is derived from a conventional cord 62 and plug 64 wound on spool 66 within motor compartment 26.

A tool container 68 is located within canister 10 in the vacuuming configuration. Tool container 68 is adapted to receive various vacuuming tools, and can be accessed by removing lid 70 on hatch 72 in cover 16 above motor compartment 26. A hinged screen 74 supports filter bag 32 so that it is not drawn beneath tool container 68, or the opening left if container 68 is removed. A groove 76 is formed on the underside of tool tray 68 to provide a free flow of air from within the chamber 26 through aperture 30, as illustrated by arrow 78.

Switch 56 is used to activate motor 54 so that air pump 52 provides a suction action. Switch 20 must be closed for motor 54 to operate. Air pump 52 draws air from the interior of chamber 26 through aperture 30, as illustrated by arrow 78. Air is thus drawn through vacuum head 40, wand 38, hose 36, into filter bag 32. The side walls of filter bag 32 are porous so that the air is drawn out through the side walls of the bag, while dust, dirt and other particulate matter is trapped inside. As such, the preferred embodiment operates in the same fashion and equally as efficiently as a conventional vacuum cleaner.

2. Liquid Cleaning Configuration

Figure 4:
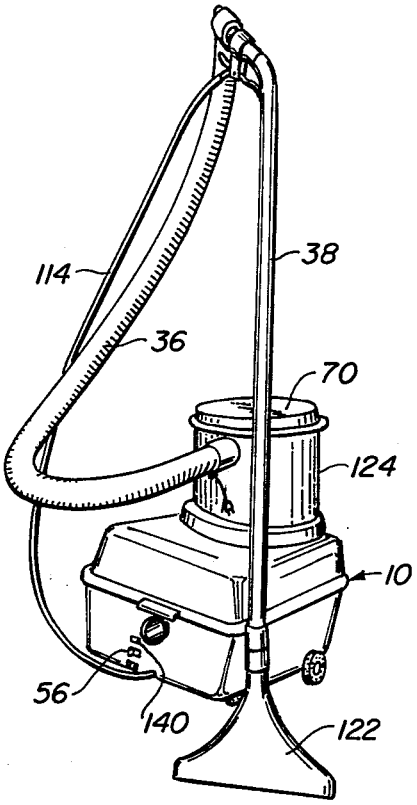
FIG. 4 is a perspective view of the preferred embodiment in its liquid cleaning configuration.
Figure 5:
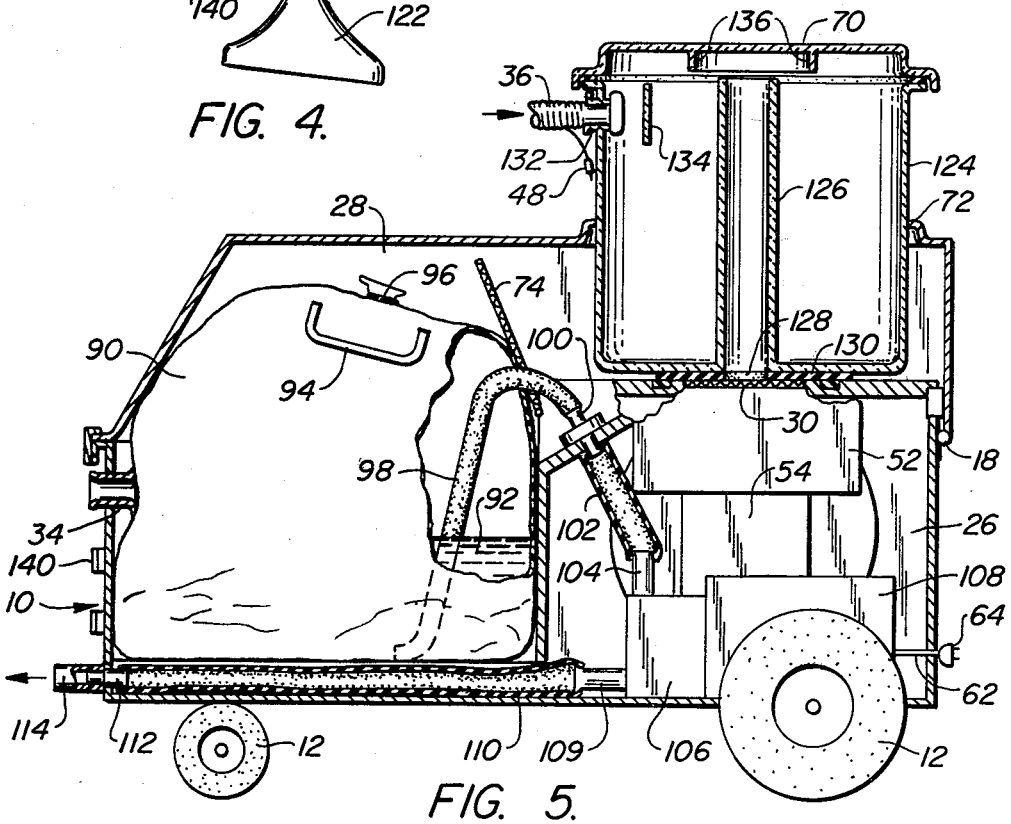
FIG. 5 is a side sectional partially cut away view of the preferred embodiment in its liquid cleaning configuration.

The system of the present invention can readily be converted into a liquid cleaning configuration, as illustrated in FIGS. 4 and 5. In the liquid cleaning configuration, a solution bag 90 is placed in the bag-receiving cavity of chamber 28 in place of the filter bag. Solution bag 90 contains a cleaning solution 92 of the type used for the liquid cleaning of carpets. Handles 94 can be used to facilitate filling bag 90 at a sink and insertion of the bag in chamber 28 when cover 16 is lifted (see FIG. 3). The mouth 96 of solution bag 90 is sealed, and the bag does not communicate with vacuum hose fitting 34, which is inoperative in the liquid cleaning configuration. Hinged screen 74 prevents the solution bag from being abraded against the sharp corner of the edge of motor compartment 26.

A tube 98 emanates from the bottom of solution bag 90, and attaches to a hose fitting 100 communicating with the interior of motor compartment 26. Fitting 100 includes a check valve to prevent water from being drawn into chamber 28 during the vacuum operation. A tube 102 connects fitting 100 with an input fitting 104 to a liquid pump 106, powered by pump motor 108. Liquid pump 106 has an output fitting 109 communicating through hose 110 to an output fitting 112 penetrating the front side of canister 10.

A liquid dispensing tube 114 is connected to hose fitting 112. As illustrated in FIGS. 8 and 9, dispensing tube 114 is attached to a clamp 116 which snaps over the upper end of two-piece wand 38. A handle 118 on clamp 116 serves as a trigger to control the flow of liquid through tube 114. Tube 114 is received within slit tube 42 on wand 38 and terminates in a spray nozzle 120 at the base of wand 38.

A liquid extraction head 122 is located at the free end of wand 38, and nozzle 120 is attached to the liquid extraction head. Liquid extraction head 122 is illustrated in more detail by way of reference to FIGS. 10 and 11. The side walls of extraction head 122 taper outwardly toward the bottom when the head is viewed from the front, as illustrated in FIG. 10. Correspondingly, these same side walls taper inwardly toward the bottom when viewed from the side, as illustrated in FIG. 11. These respective tapers were designed to provide the extraction head with the same cross sectional area in any vertical position on the head. As a result, a smooth sucking action is provided for liquid extraction.

Referring back to FIGS. 4 and 5, a recovery tank 124 is inserted through hatch 72. Lid 70 is removed from hatch 72 and placed on top of recovery tank 124. A vertical pipe 126 is located within recovery tank 124, and communicates with a hole 128 in the bottom of the tank. A rubber seal 130 surrounds hole 128. Hole 128 is aligned with aperture 30 providing access to air pump 52 in motor compartment 26.

Figure 7:
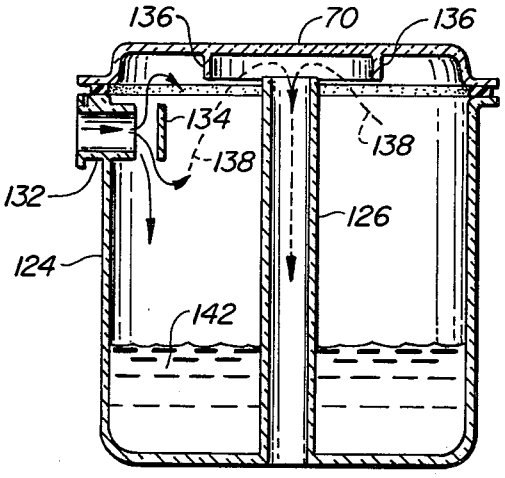
FIG. 7 is a sectional view taken along lines 7—7 of FIG. 6.

Recovery tank 124 is illustrated in detail in FIGS. 6 and 7. A liquid cleaning hose connection 132 penetrates the side of recovery tank 124, and hose 36 is attached to this hose fitting (FIG. 5). Plug 48 is not used in the liquid cleaning configuration, and hangs free remote from any socket to prevent a mistaken electrical connection. As discussed in more detail hereinafter, a mixture of recovered cleaning solution and air enters recovery tank 124 through hose connection 132. A baffle 134 is located within recovery tank 126 in the path of this incoming material. As a result, the cleaning solution and entrained impurities and other heavier than air material fall to the bottom of the recovery tank and is collected therein. A circular baffle 136 is located on the underside of lid 70. The combination of baffles 134 and 136 insure that only air reaches the top of vertical pipe 126, as illustrated by dashed arrows 138. As a result, cleaning solution and other impurities cannot reach and contaminate air pump 52.

Switch 140 is used to actuate motor 108 for liquid pump 106 in the liquid cleaning configuration. Pump 106 draws cleaning solution 92 from solution bag 90, and supplies it under pressure to liquid dispensing tube 114. Trigger 118 on wand 136 is used to manually control the dispensing of cleaning solution through spray nozzle 120.

In the liquid cleaning configuration, switch 56 is turned on to actuate motor 54 driving air pump 52. Air pump 52 thus provides a suction action which draws air from the interior of recovery tank 124. As a result, air is drawn into the recovery tank through hose 36 and wand 38, providing a suction at water extraction head 122. Accordingly, air and entrained cleaning solution enters the recovery tank 124, the used cleaning solution 142 being collected within the recovery tank.

In the liquid cleaning configuration, the preferred embodiment serves as a complete cleaning system, containing all of the elements found in conventional liquid cleaning systems. No liquid cleaning operations are compromised to conform to the system's use in its vacuuming configuration.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A carpet cleaning system convertible between a vacuuming configuration and a liquid cleaning configuration, said system comprising:

a canister including a motor compartment and a chamber partially overlying the motor compartment in communication therewith through an aperture in the top of the motor compartment and having a bag-receiving cavity, said canister further including an upwardly opening hatch for access to the chamber above the motor compartment, and means for providing access to the bag-receiving cavity;

a vacuum hose connection penetrating the bag-receiving cavity of the chamber;

an air pump located in the motor compartment and having an input side communicating with the chamber through the aperture in the top of the motor compartment;

a liquid pump located in the motor compartment and having an input side communicating with an input fitting inside the chamber and an output side communicating with an output fitting on the exterior of the canister;

an air tight dome engaged with the hatch when the system is in the vacuuming configuration;

a recovery tank including a liquid cleaning hose connection penetrating the tank and a central vertical pipe communicating with a hole in the base of the tank, said tank being inserted in the hatch when the system is in the liquid cleaning configuration so that the hole is aligned with the aperture in the top of the motor compartment;

a filter bag inserted in the bag-receiving cavity when the system is in the vacuuming configuration, said filter bag being connected to the vacuuming hose connection;

a solution bag inserted to the bag-receiving cavity when the system is in the liquid cleaning configuration, said solution bag being connected to the input fitting of the liquid pump;

a cleaning solution dispensing tube attached to the output fitting of the liquid pump when the system is in the liquid cleaning configuration to dispense a cleaning solution pumped from the solution bag; and a hose and wand assembly attached to the vacuuming hose connection when the system is in the vacuuming configuration so that the air pump draws air through the hose and wand into the filter bag and out through the walls of the bag to provide a vacuuming action, said hose and wand assembly being attached to the liquid cleaning hose connection in the liquid cleaning configuration so that air drawn from the tank through the vertical pipe by the air pump provides suction to draw the dispensed cleaning solution through the hose and wand and into the recovery tank.

2. A carpet cleaning system as recited in claim 1 wherein the canister is mounted on wheels.

3. A carpet cleaning system as recited in claim 1 wherein the bag-receiving cavity of the chamber is located generally to the side of the motor compartment.

4. A carpet cleaning system as recited in claim 1 wherein the hose and wand assembly includes a power vacuuming head attached to the wand in the vacuuming configuration, and a liquid extraction head attached to the wand in the liquid cleaning configuration.

5. A carpet cleaning system as recited in claim 4 wherein the liquid extraction head has a generally constant sectional area to facilitate the suction action.

6. A carpet cleaning system as recited in claim 1 and additionally comprising a control for the cleaning solution dispensing tube adapted to snap on the wand when the system is in the liquid cleaning configuration.

7. A carpet cleaning system as recited in claim 1 and additionally comprising a baffle interposed in the flow path of the dispensed cleaning solution within the tank to prevent the cleaning solution from entering the vertical pipe within the tank and contaminating the air pump.

8. A carpet cleaning system as recited in claim 1 wherein the canister includes a hinged top providing access to the bag-receiving cavity.

9. A carpet cleaning system as recited in claim 1 and additionally comprising a tool tray adapted to be inserted within the chamber overlying the motor compartment in the vacuuming configuration, said tool tray having a groove formed in the underside thereof to allow the free flow of air from the chamber to the air pump through the aperture in the top of the motor compartment.

10. A carpet cleaning system as recited in claim 1 wherein the hose and wand assembly comprises a single hose and wand used in both the vacuuming configuration and the liquid cleaning configuration.

11. A carpet cleaning system as recited in claim 1 and additionally comprising a screen partially supporting the filter bag to prevent deformation of the bag.

12. A carpet cleaning system as recited in claim 1 and additionally comprising a pressure switch sensing excess vacuum in the chamber and a warning light actuated by the switch.

* * * * *